US011725810B2

(12) United States Patent
Trublowski et al.

(10) Patent No.: US 11,725,810 B2
(45) Date of Patent: Aug. 15, 2023

(54) HEAT SINK FOR LUMINAIRE AND LUMINAIRE ARRANGEMENTS HAVING A HEAT SINK

(71) Applicants: EATON INTELLIGENT POWER LIMITED, Dublin (IE); Rensselaer Polytechnic Institute, Troy, NY (US)

(72) Inventors: John Trublowski, Troy, MI (US); Lucas Stahl, Detroit, MI (US); Jeremy Santiago, Southfield, MI (US); Christopher Ring, Derry, NH (US); Adikaramge Jayawardena, Manlius, NY (US); Ukwatte Lokuliyanage Indika Upendra Perera, Clifton Park, NY (US); Nadarajah Narendran, Clifton Park, NY (US); Nilay Mehta, Peachtree, GA (US); Jean Paul Freyssinier, Troy, NY (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/587,483

(22) Filed: Jan. 28, 2022

(65) Prior Publication Data

US 2022/0260243 A1 Aug. 18, 2022

Related U.S. Application Data

(60) Provisional application No. 63/143,242, filed on Jan. 29, 2021.

(51) Int. Cl.

| | |
|---|---|
| ***F21V 29/77*** | (2015.01) |
| ***F21V 29/83*** | (2015.01) |
| ***F21K 9/235*** | (2016.01) |
| *F21Y 115/10* | (2016.01) |

(52) U.S. Cl.
CPC ..... *F21V 29/777* (2015.01); *F21K 9/235* (2016.08); *F21V 29/83* (2015.01); *F21Y 2115/10* (2016.08)

(58) Field of Classification Search
CPC ..... F21K 9/235; F21V 29/777; F21V 29/83; F21Y 2115/10
See application file for complete search history.

(56) References Cited

FOREIGN PATENT DOCUMENTS

| | | |
|---|---|---|
| CN | 203010553 | 6/2013 |
| CN | 103672806 | 3/2014 |
| CN | 207230458 | 4/2018 |
| CN | 208332105 | 1/2019 |
| CN | 110566824 | 12/2019 |
| CN | 211600625 | 9/2020 |
| EP | 2128516 | 12/2009 |

(Continued)

OTHER PUBLICATIONS

Search Report; Corresponding EP Application Serial No. 22154096; Examiner Arthur Thibaut; dated May 25, 2022.

*Primary Examiner* — Britt D Hanley
(74) *Attorney, Agent, or Firm* — Squire Patton Boggs (US) LLP

(57) ABSTRACT

A heat sink for a luminaire includes a central portion having a top surface and a bottom surface. The bottom surface is adapted to receive a lighting arrangement. The heat sink further includes a plurality of arms configured to dissipate heat generated by the lighting arrangement. The plurality of arms extend radially outward from the central portion. Each one of the plurality of arms is substantially arcuate between a proximal end and a distal end.

11 Claims, 12 Drawing Sheets

(56) References Cited

FOREIGN PATENT DOCUMENTS

| | | |
|---|---|---|
| EP | 2725295 | 4/2014 |
| SE | 1651102 | 2/2018 |
| WO | 2016012146 | 1/2016 |

HEAT SINK FOR LUMINAIRE AND LUMINAIRE ARRANGEMENTS HAVING A HEAT SINK

CROSS-REFERENCE TO RELATED APPLICATION

This disclosure claims the benefit of the filing date of U.S. Provisional Patent Application No. 63/143,242, filed on Jan. 29, 2021, the disclosure of which is incorporated by reference in its entirety.

GOVERNMENT INTEREST

This invention was made with government support under DE-EE0008722 awarded by the United States Department of Energy. The government has certain rights in the invention.

FIELD OF INVENTION

The present disclosure relates to lighting. More particularly, the present disclosure relates to a heat sink for a luminaire and luminaire arrangements that have a heat sink.

BACKGROUND

Environmental concerns and economic factors have driven the development of technologies that reduce energy consumption. One area where substantial energy savings may be realized is the field of luminaires (e.g., lighting units). Traditionally, luminaires have utilized incandescent bulbs to provide illumination. While incandescent bulbs provide sufficient illumination, they may be undesirable in regard to comparatively high power consumption and comparatively short service life. Light emitting diode (LED) bulbs are known to consume approximately 75% less energy than an incandescent bulb of equivalent lumens, thereby offering substantial energy savings. Additionally, LED bulbs may last up to 20 times as long as an equivalent incandescent bulb.

LED bulb service life may be maximized by keeping the LED bulb below 85° C. during operation. While it is known to provide LED bulbs with heat sinks to meet this operation goal, known heat sinks are visually unappealing or have limited effectiveness and design flexibility. These limitations can be attributed to, in part, known heat sink manufacturing processes, such as casting and extruding.

SUMMARY OF THE INVENTION

In one embodiment, a heat sink for a luminaire includes a central portion having a top surface and a bottom surface. The bottom surface is adapted to receive a lighting arrangement. The heat sink further includes a plurality of arms configured to dissipate heat generated by the lighting arrangement. The plurality of arms extend radially outward from the central portion. Each one of the plurality of arms is substantially arcuate between a proximal end and a distal end.

In another embodiment, a luminaire includes a base, an LED driver provided on the base, and a heat sink. A connection mechanism attaches the heat sink to the base. The connection mechanism is configured to adjustably fix an orientation of the heat sink relative to the base. An LED lighting arrangement is secured to the heat sink. The base is provided with base fins and the heat sink is provided with heat sink fins. Each of the base fins and the heat sink fins extends along a longitudinal direction of the luminaire.

In another embodiment, a method of manufacturing a luminaire includes depositing layers of material to form a main portion having a first surface and a second surface opposite the first surface. The method further includes securing an LED lighting arrangement to the first surface. The method further includes depositing layers of material to form a heat dissipation structure. The heat dissipation structure is provided on the second surface. The heat dissipation structure includes a plurality of fins, each fin of the plurality of fins includes a V-shaped portion and a linear portion. The linear portion connects the V-shaped portion to the main portion.

BRIEF DESCRIPTION OF DRAWINGS

In the accompanying drawings, structures are illustrated that, together with the detailed description provided below, describe exemplary embodiments of the claimed invention. Like elements are identified with the same reference numerals. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

Figure 1:
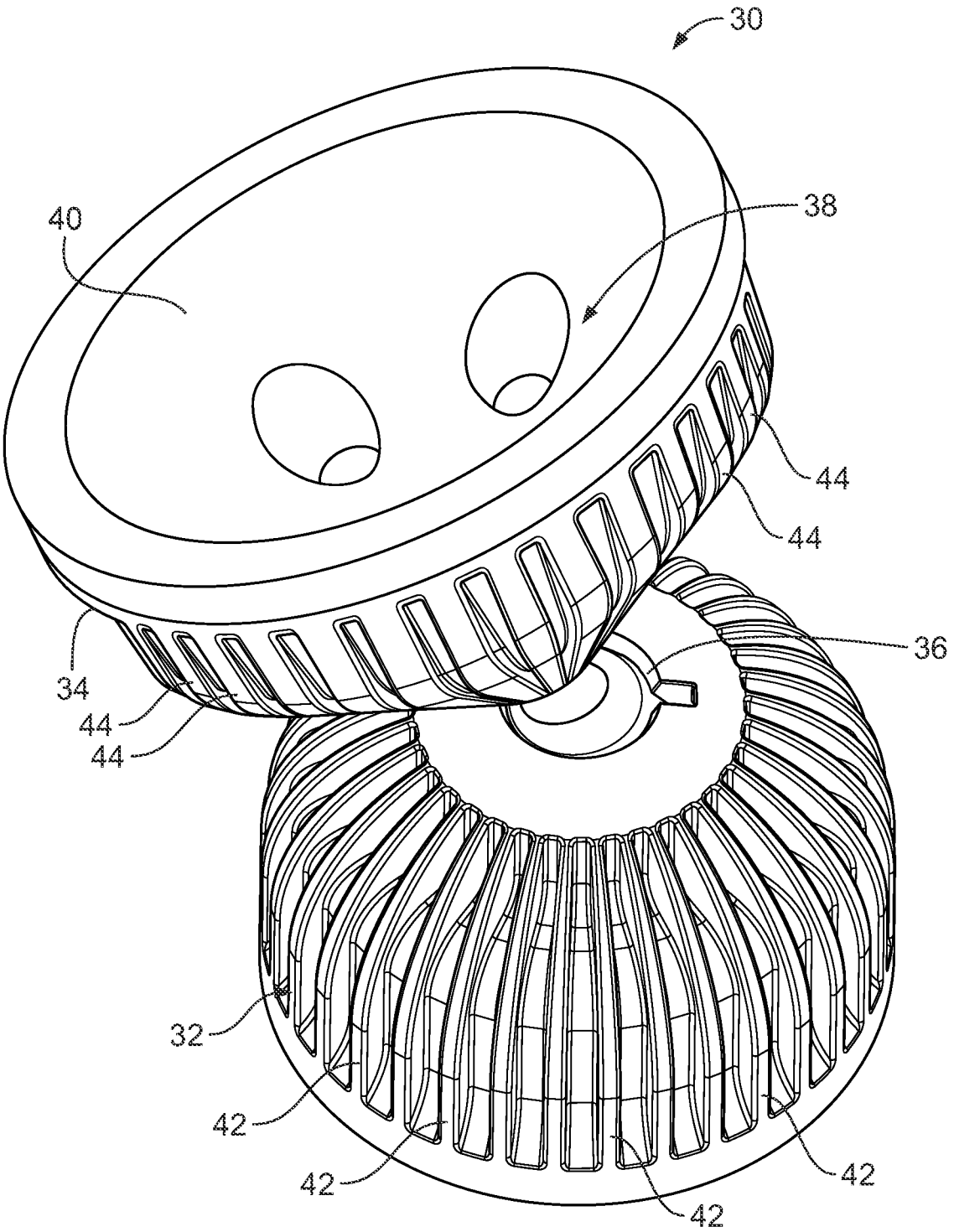
FIG. 1 is a perspective view of one embodiment of a LED luminaire.
Figure 2:
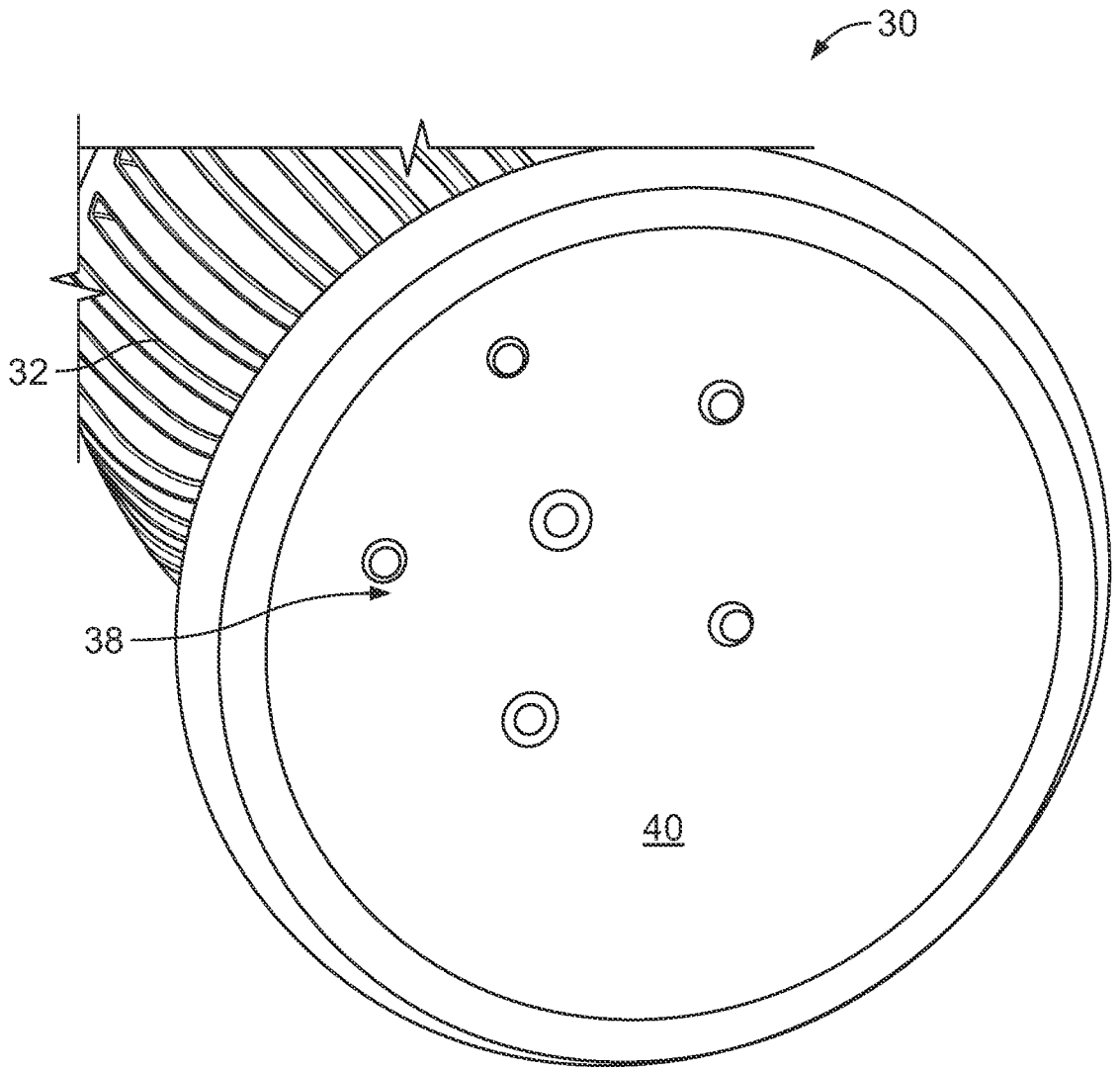
FIG. 2 is a bottom view of part of the LED luminaire of FIG. 1.

FIGS. 1 and 2 show one embodiment of an LED luminaire 30. The luminaire 30 includes a base 32 and a heat sink 34.

The base 32 may be used to attach the luminaire 30 to a desired structure such as, for example, a ceiling of a building. A driver (not shown) is provided in the base 32. The driver converts an input power supply to an output power supply appropriate for an LED.

A connection mechanism 36 connects the heat sink 34 to the base 32. The connection mechanism 36 may be configured to permit the heat sink 34 to be fixed at a desired orientation relative to the base 32. In the illustrated embodiment, the connection mechanism 36 is a ball and socket joint. In alternative embodiments, the connection mechanism may be any desired arrangement.

An LED lighting arrangement 38 and a reflector 40 are attached to the heat sink 34. In the illustrated embodiment, the LED lighting arrangement 38 includes five discrete LEDs that include four LEDs arranged around a single centrally located LED. In alternative embodiments, the LED lighting arrangement may include a greater or fewer number of LEDs, and the LEDs may be provide in any desired arrangement. The reflector 40 is configured to direct and focus light emitted by the LED lighting arrangement 38 in a desired manner. Design parameters of the reflector 40 may be altered to provide the luminaire 30 with desired lighting characteristics. For example, the reflector may 40 be designed to provide a relatively narrow beam of relatively high intensity, or may be designed to provide a relatively wide beam of relatively low intensity.

An exterior surface of the base 32 is provided with base fins 42. Similarly, an exterior surface of the heat sink 34 is provided with heat sink fins 44. In the illustrated embodiment, the base fins 42 and the heat sinks fins 44 are provided on the entire exterior surface of the base 32 and the heat sink 34, respectively. The base fins 42 and heat sink fins 44 are curved according to the contours of the base 32 and heat sink 34, and extend linearly along a longitudinal direction of the luminaire 30. In alternative embodiments, the base fins or the heat sink fins may have any desired arrangement.

The driver and the LED lighting arrangement 38 each generate heat during operation of the luminaire 30. The base 32 and the heat sink 34 dissipate generated heat into the surrounding atmosphere. The base fins 42 and the heat sink fins 44 increase the surface area (and the surface area to volume ratio) of the base 32 and the heat sink 34, respectively, thereby improving heat dissipation performance.

Figure 3:
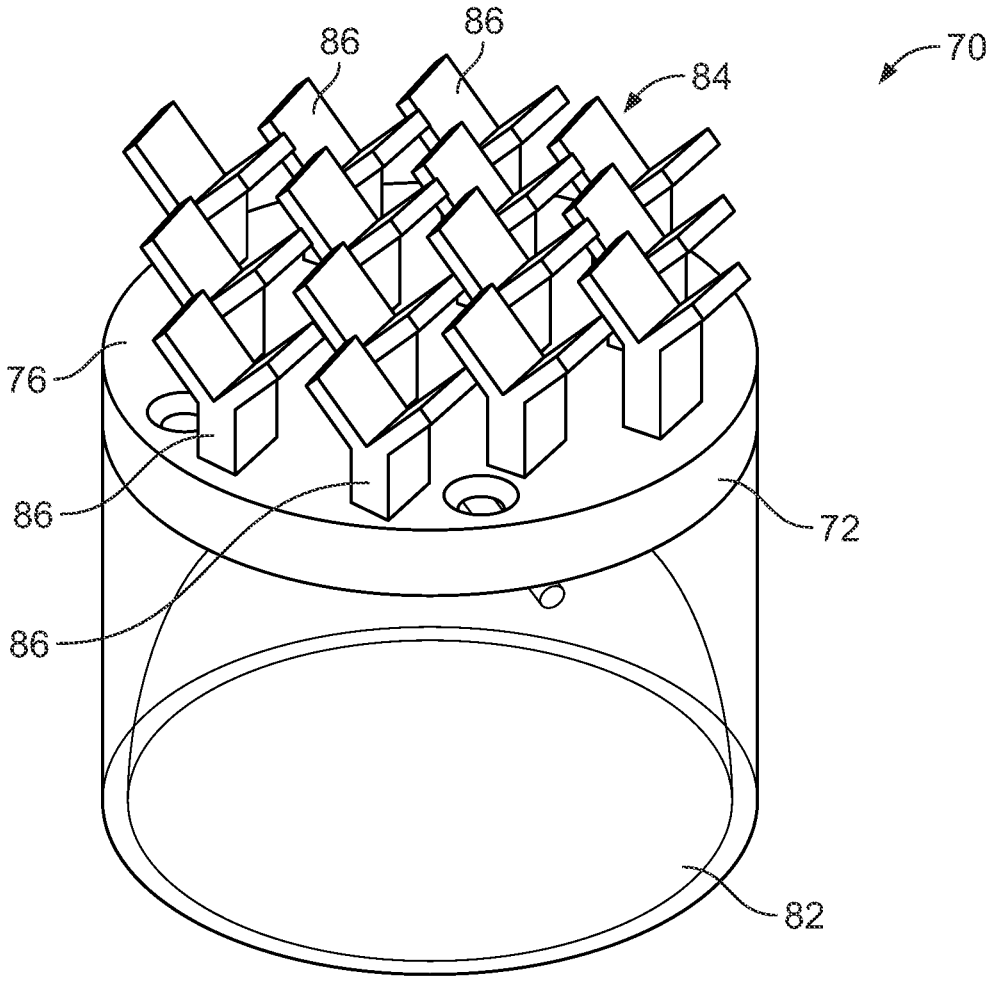
FIG. 3 is a perspective view of an alternative embodiment of a LED luminaire.
Figure 4:
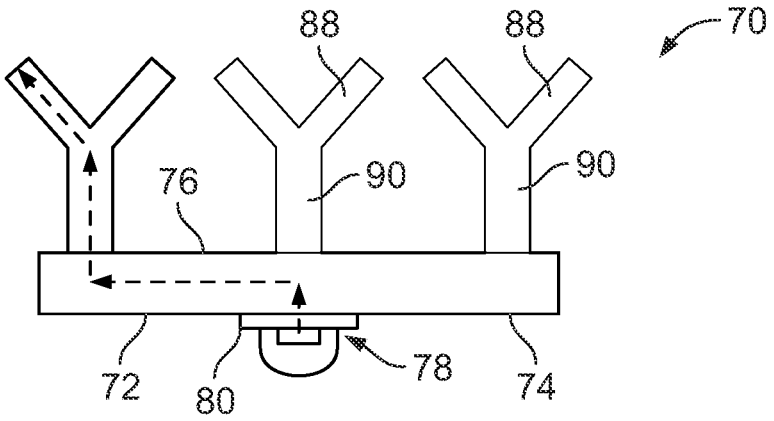
FIG. 4 is a sectional view of part of the LED luminaire of FIG. 3 showing movement of heat through a heat sink.

FIGS. 3 and 4 show an alternative embodiment of an LED luminaire 70. The luminaire 70 includes a main portion 72 having a first surface 74 and a second surface 76. An LED lighting arrangement 78 and a driver 80 are attached to the first surface 74. The driver 80 converts an input power supply to an output power supply appropriate for the LED lighting arrangement 78. A reflector 82 is secured to the first surface 74. The reflector 82 directs and focuses light emitted by the LED lighting arrangement 78.

Heat dissipation structure 84 is provided on the second surface 76. In the illustrated embodiment, the heat dissipation structure 84 includes a plurality of fins 86. Each fin 86 includes a V-shaped portion 88 and a linear portion 90 that connects the V-shaped portion 88 to the second surface 76. Thus, the plurality of fins 86 may be described as Y-shaped fins. In alternative embodiments, the heat dissipation structure may have any desired arrangement.

During operation of the luminaire 70 the LED lighting arrangement 78 and the driver 80 generate heat. The generated heat is dissipated by the main portion 72. The V-shaped 88 portion of the fins 86 increases the overall surface area of the heat dissipation structure 84, thus increasing the surface area (and the surface area to volume ratio) of the main portion 72 and improving heat dissipation performance. The Y-shaped fins may allow for a more compact arrangement compared to heat dissipation structure having only straight, linear fins. Specifically, for a given surface area, a Y-shaped fin will be shorter than a corresponding fin that is purely linear.

Figure 5:
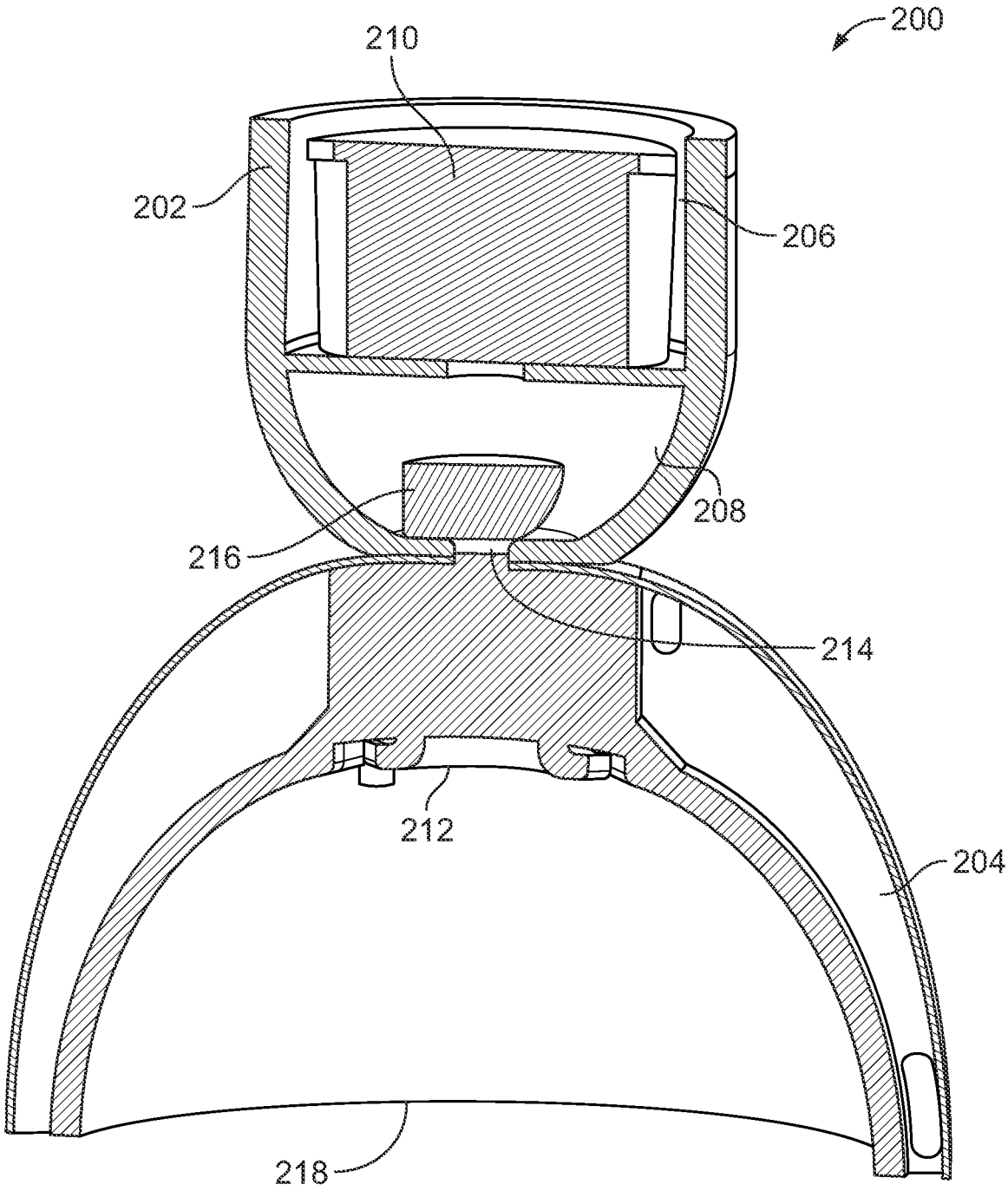
FIG. 5 is a sectional view of another alternative embodiment of a LED luminaire.

FIG. 5 shows another alternative embodiment of an LED luminaire 200. The luminaire 200 includes a base 202 and a heat sink 204. The base 202 may be used to attach the luminaire to a structure. The base 202 includes an upper portion 206 and a lower portion 208. A driver 210 is provided in the upper portion 206. The driver converts an input power supply to an LED appropriate output power supply.

An LED lighting arrangement 212 is mounted to the heat sink 204. The heat sink 204 is provided with a first connection mechanism 214 that cooperates with a second connection mechanism 216 provided in the lower portion 208 of the base 202 to attach the heat sink 204 to the base 202. The first and second connection mechanisms 214, 216 may be configured to permit the heat sink 204 to be fixed at a desired orientation relative to the base 202. A reflector 218 is attached to the heat sink 204. The reflector 218 directs and focuses light emitted by the LED lighting arrangement 212.

Figure 6:
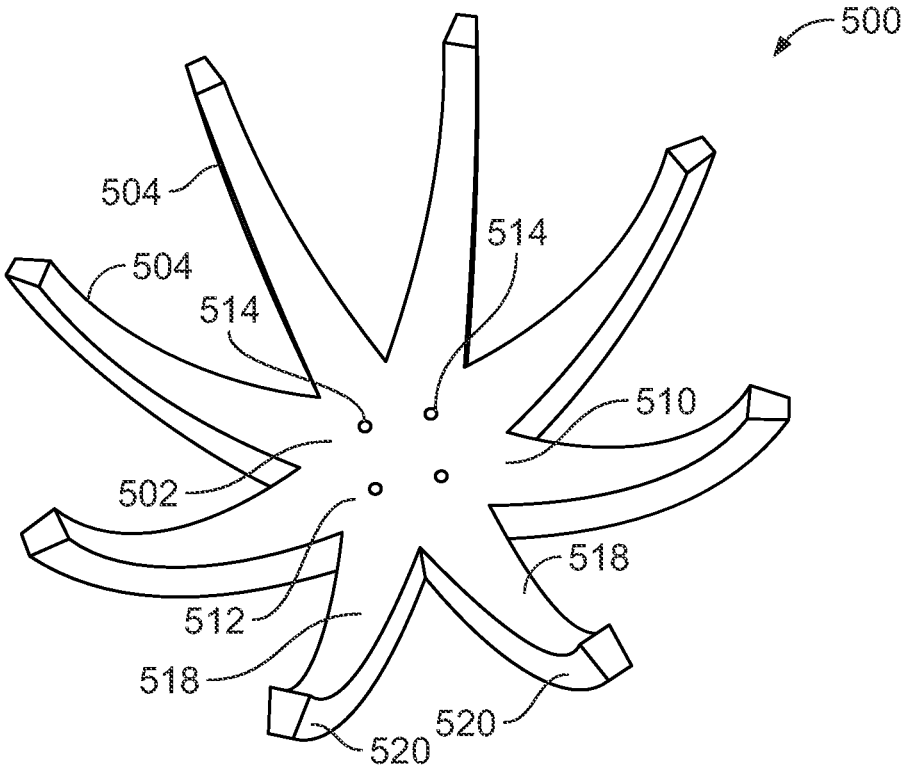
FIG. 6 is a bottom perspective view of one embodiment of a heat sink that may be used with the LED luminaire of FIG. 5.
Figure 7:
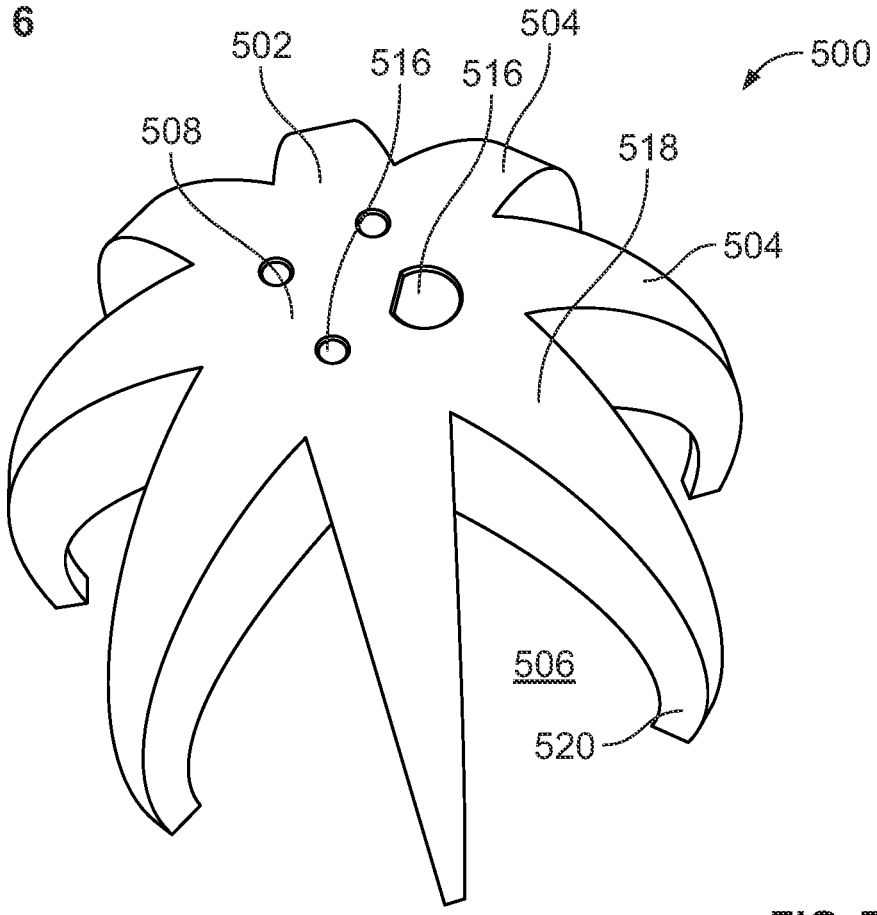
FIG. 7 is a top perspective view of the heat sink of FIG. 6.

FIGS. 6 and 7 show an embodiment of a heat sink 500 that may be used with the LED luminaire 200 of FIG. 5. The heat sink 500 includes a central portion 502 and plurality of arms (or spokes) 504 extending therefrom. In the illustrated embodiment, the central portion 502 and the arms 504 cooperate to define a semi-spherical shaped interior space 506. In alternative embodiments, the central portion and the arms may be arranged to define any shaped interior space.

The central portion 502 includes an upper surface 508 and a lower surface 510. An LED lighting arrangement 512 (shown schematically in broken lines) is attached to the lower surface 510. The lower surface 510 includes mounting apertures 514 to facilitate attachment of the LED lighting arrangement 512. In the illustrated embodiment, the central portion 502 includes four mounting apertures 514 that are arranged in a square-shape. In alternative embodiments, the central portion may include any desired number of mounting apertures that are arranged in any desired shape, or the mounting apertures may be omitted. Additionally, in the illustrated embodiment, the upper surface 508 of the central portion 502 includes four manufacturing apertures 516. The manufacturing apertures 516 are created during the process of manufacturing the heat sink 500 and, in the illustrated embodiment, serve no functional purpose. In alternative embodiments, the manufacturing apertures may be functional and be used, for example, to run wiring, attach the heat sink to a desired structure, or any other desired purpose. In other alternative embodiments the manufacturing apertures may be omitted.

The arms 504 extend radially from the central portion 502. In the illustrated embodiment, the heat sink 500 includes eight arms 504 that are equally spaced from one another about the central portion 502. In alternative embodiments, the heat sink may include any desired number of arms, and the arms may have any desired spacing from one another.

Each arm 504 extends along a longitudinal axis between a proximal end 518 that is attached to the central portion 502 and a distal end 520 that is spaced from the central portion 502. In the illustrated embodiment, each arm 504 has a substantially continuously arcuate profile between the proximal end 518 and the distal end 520, and has a trapezoid-shaped cross section. In alternative embodiments, each arm may have any desired profile or have any desired shaped cross section.

In use, heat generated by the LED lighting arrangement 512 is transferred to the central portion 502. The heat moves from the central portion 502, into each arm 504 via the respective proximal end 518, and toward the respective distal end 520. The arms 504, in addition to the central portion 502, dissipate the heat into the surrounding atmosphere.

Figure 8:
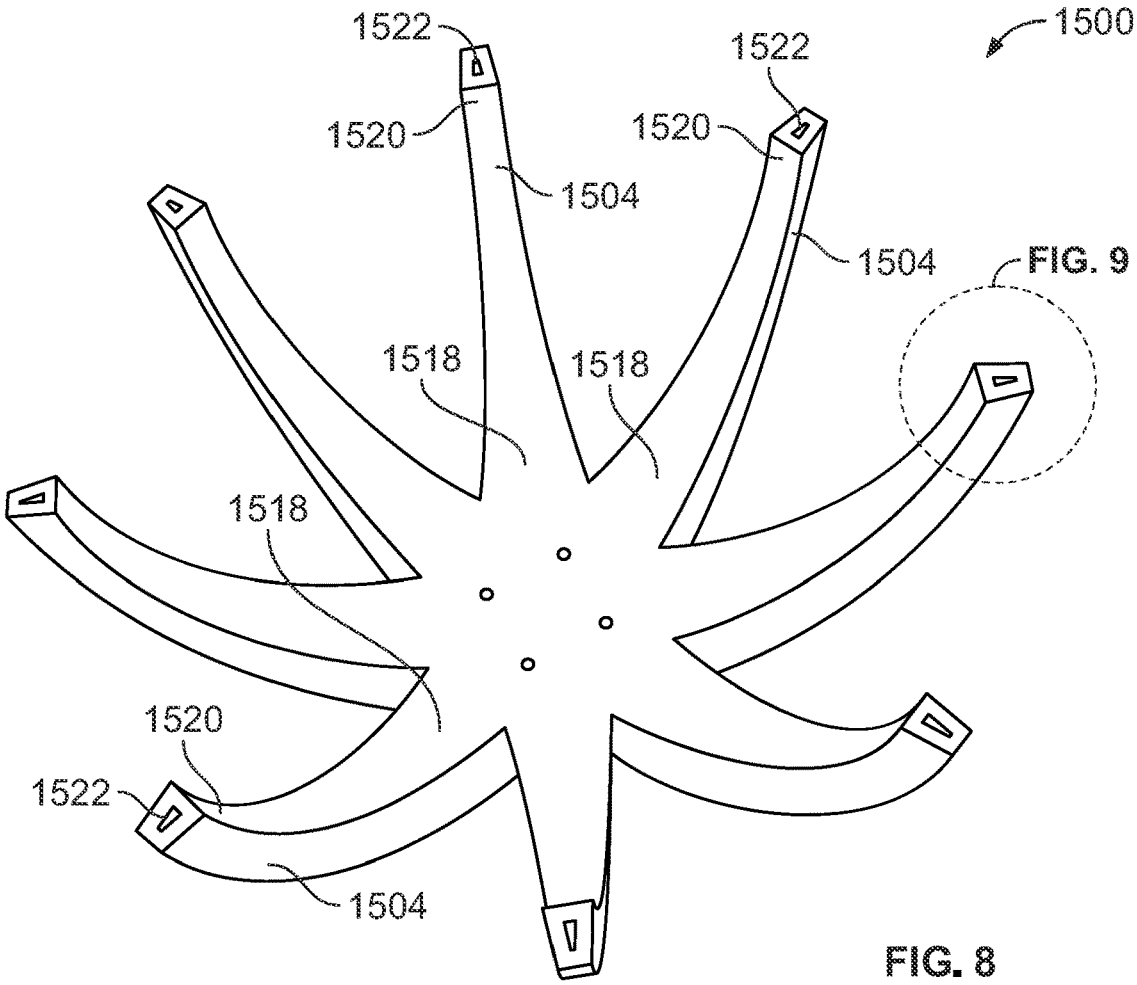
FIG. 8 is a bottom perspective view of a variation of the heat sink of FIGS. 6 and 7.
Figure 9:
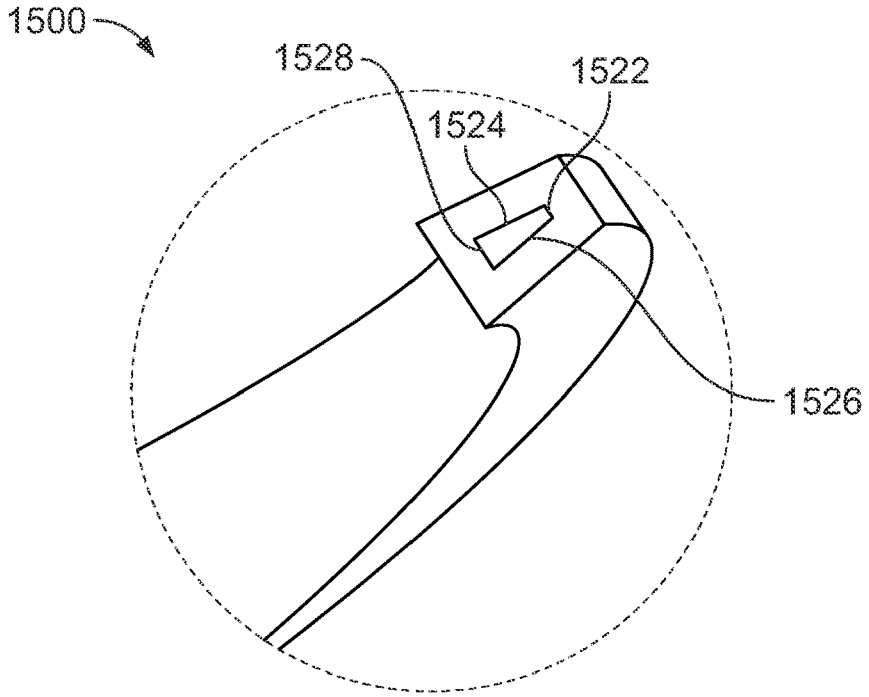
FIG. 9 is a detail view of part of the heat sink of FIG. 8.

FIGS. 8 and 9 show a variant of the heat sink of FIGS. 6 and 7. The heat sink of FIGS. 8 and 9 is substantially similar to the heat sink of FIGS. 6 and 7, except for the differences described herein. Accordingly, like features will be identified by like numerals increased by a value of "1000." In the heat sink 1500 of FIGS. 8 and 9, each arm 1504 is hollow so as to define an interior space 1522. In the illustrated embodiment, the interior space 1522 extends continuously from between the proximal end 1518 and the distal end 1520 of the arm 1504, and interior walls 1522, 1524, 1526, 1528 that define the interior space 1522 are arranged to give the space 1522 a cross section that mimics the trapezoid cross section of the arm 1504. In alternative embodiments, the interior space may be discontinuous in the arm, and the interior walls may be arranged to give the space any desired cross section.

The hollow arms 1504 reduce material usage during manufacture of the heat sink 1500, and result in a comparatively lower weight heat sink 1500. It has been found that the heat sink 1500 with hollow arms 1504 has substantially the same heat dissipation performance as an equivalent heat sink with solid arms. However, other geometries may improve the heat dissipation performance.

Figure 10:
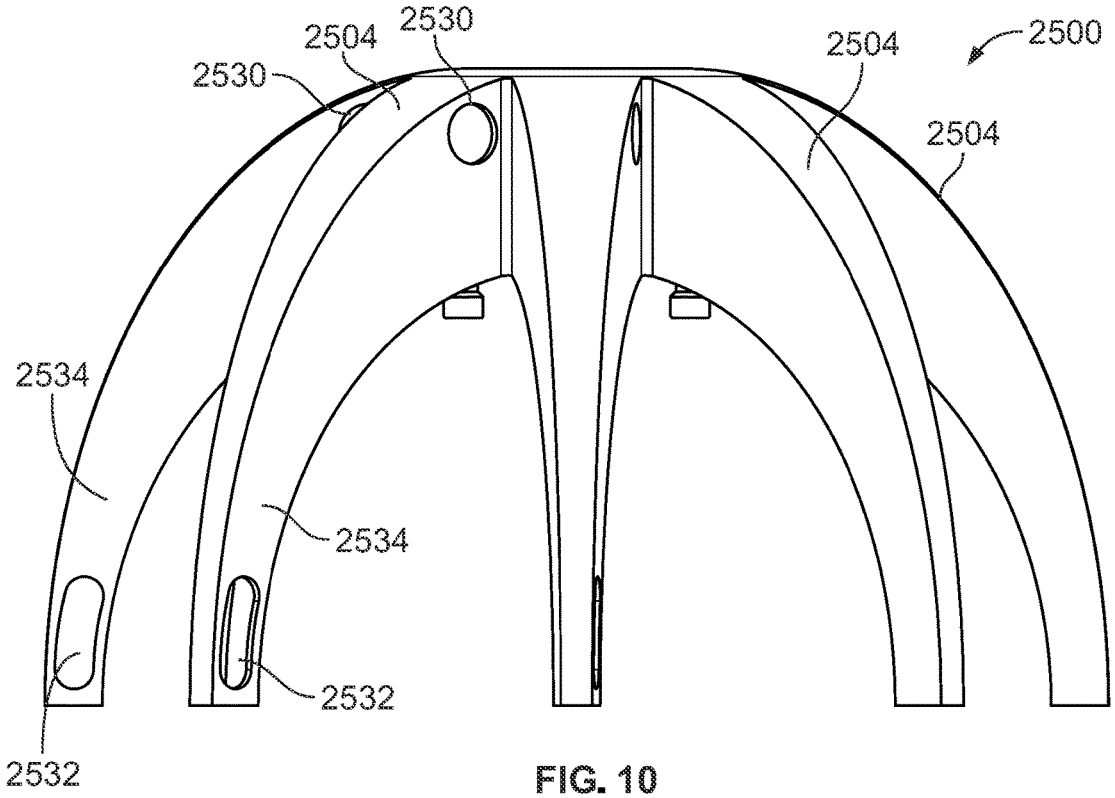
FIG. 10 is a side view of another variation of the heat sink of FIGS. 6 and 7.
Figure 11:
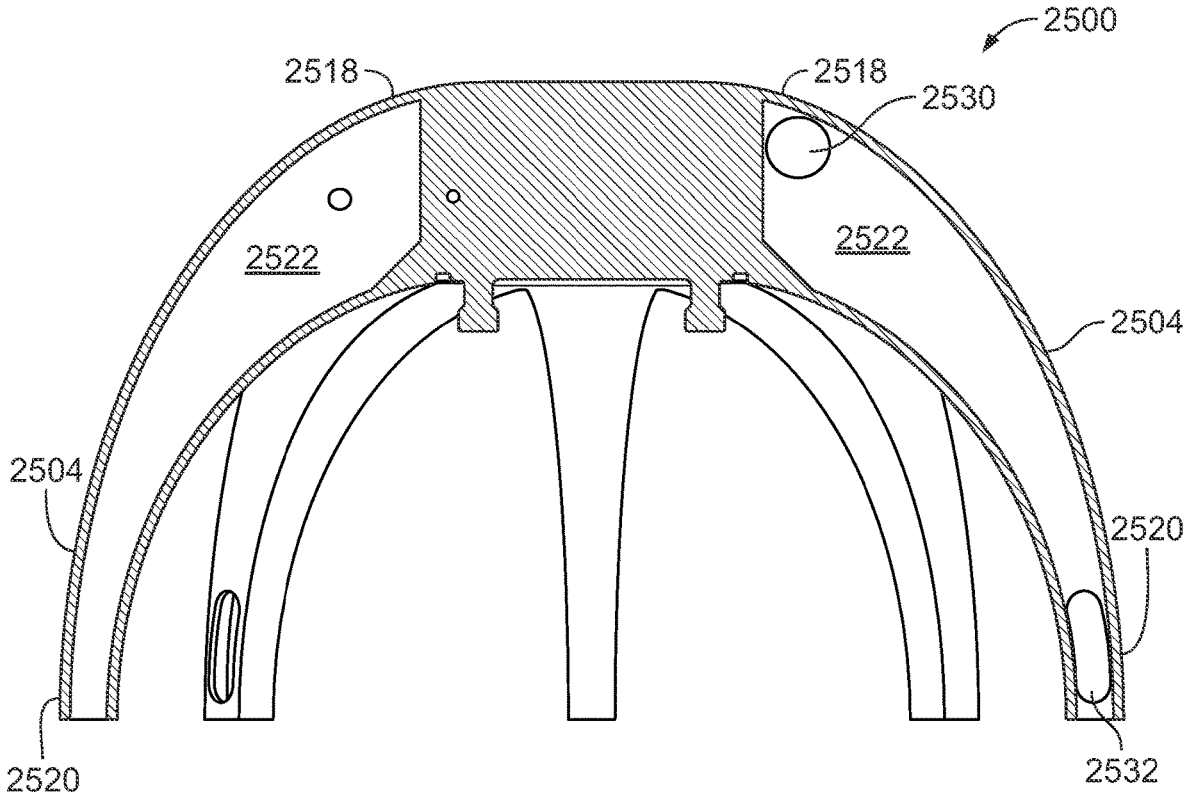
FIG. 11 is a sectional view of the heat sink of FIG. 10.

FIGS. 10 and 11 show another variant of the heat sink of FIGS. 6 and 7. The heat sink of FIGS. 10 and 11 is substantially similar to the heat sink of FIGS. 6 and 7, except for the differences described herein. Accordingly, like features will be identified by like numerals increased by a value of "2000." In the heat sink 2500 of FIGS. 10 and 11, each arm 2504 is hollow and has an interior space 2522 that extends between the proximal end 2518 and the distal end 2520 of the arm 2504. Each arm 2504 is provided with a first vent 2530 and a second vent 2532. The first and second vents 2530, 2532 are in fluid communication with the interior space 2522. The provision of the first vent 2530 and the second vent 2532 promotes convective airflow through the interior space 2522, which may improve heat dissipation performance of the heat sink.

In the illustrated embodiment, the first vent 2530 is circular and provided on a first side surface 2534 of the arm 2504 toward the proximal end 2518, while the second vent 2532 is stadium-shaped and provided on the first side 2534 of the arm 2504 toward the distal end. In alternative embodiments, the first and second vents may be any desired shape and be provided at any desired location on the arm. In other alternative embodiments, a fewer or greater number of vents may be provided.

Figure 12:
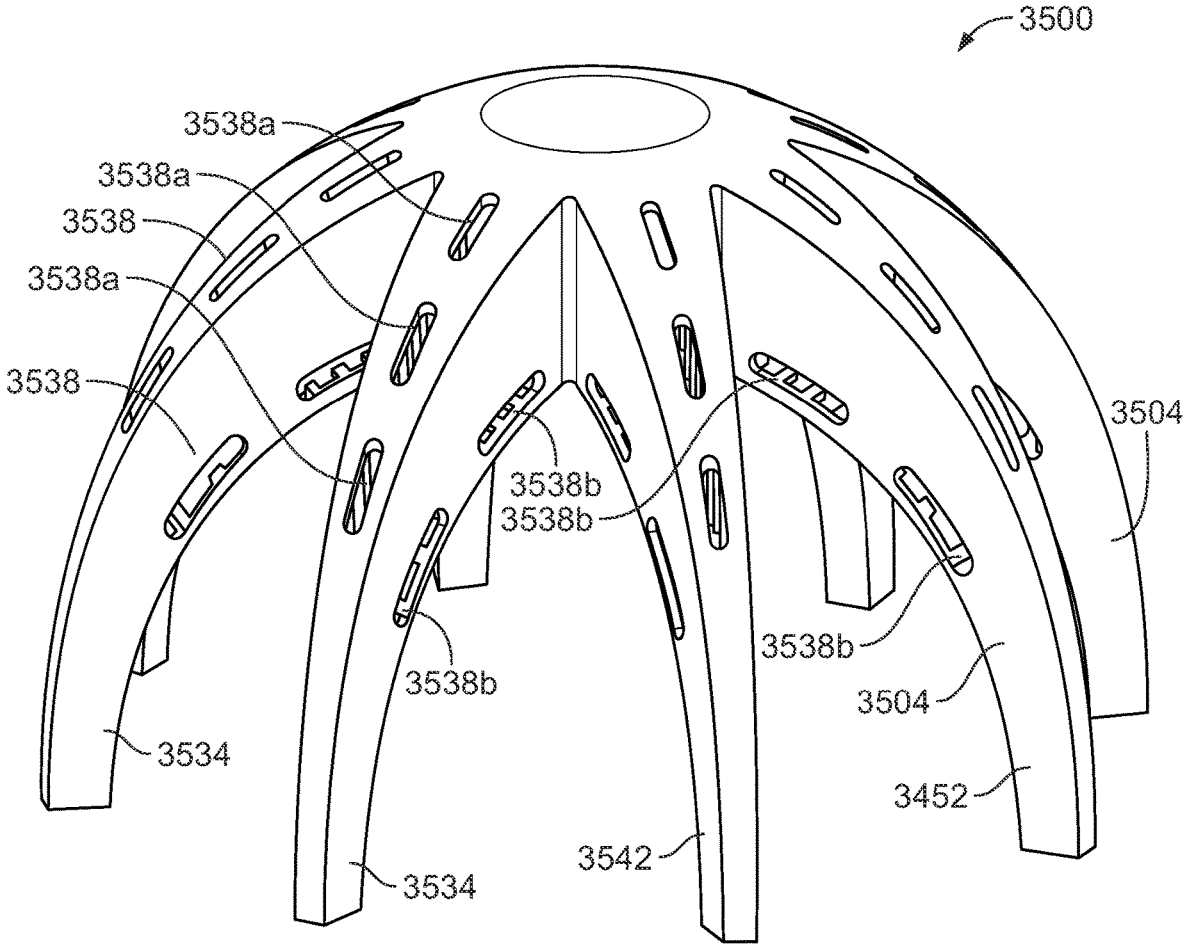
FIG. 12 is a top perspective view of another variation of the heat sink of FIGS. 6 and 7.
Figure 13:
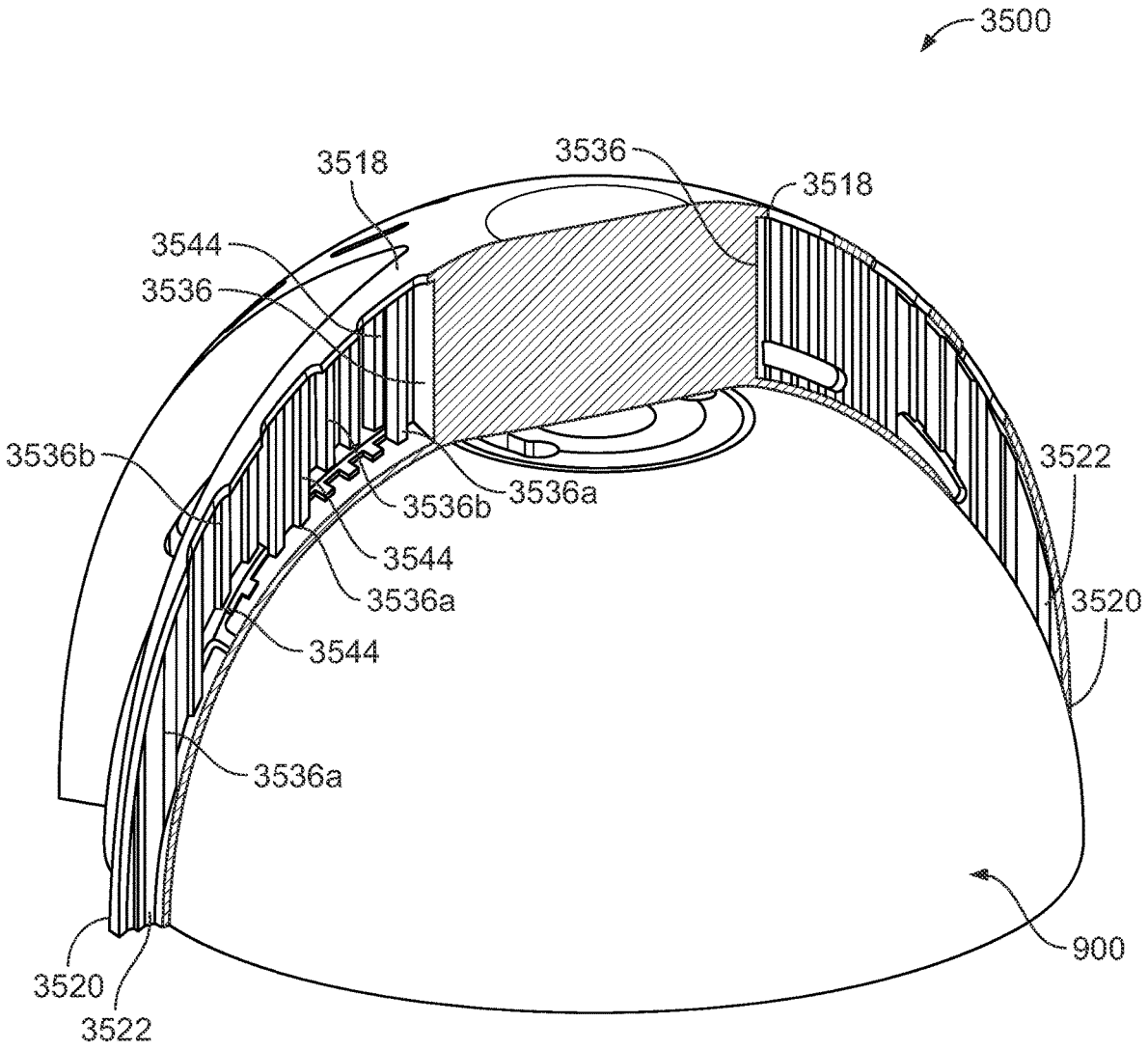
FIG. 13 is a sectional view of part of the heat sink of FIG. 12 with a reflector attached.
Figure 14:
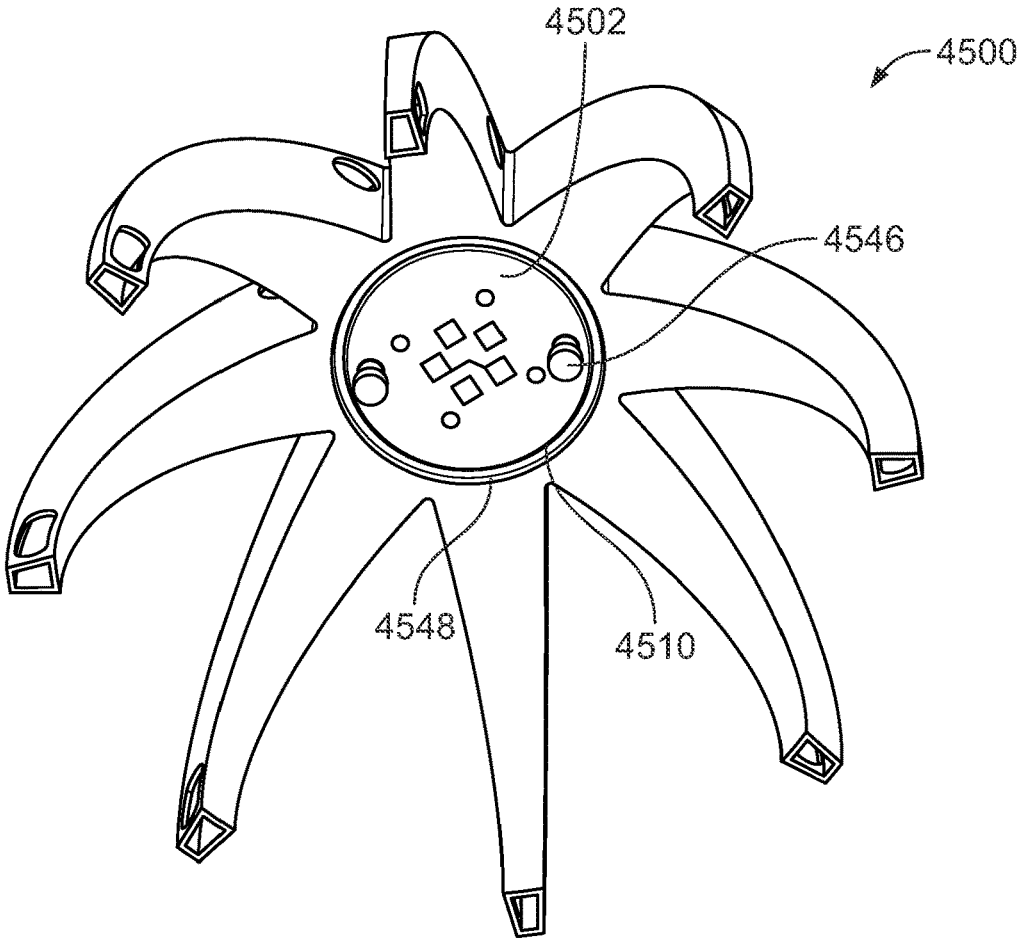
FIG. 14 is a bottom perspective view of another variation of the heat sink of FIGS. 6 and 7.

FIGS. 12 and 13 show yet another variant of the heat sink of FIGS. 6 and 7. The heat sink of FIGS. 12 and 13 is substantially similar to the heat sink of FIGS. 6 and 7, except for the differences described herein. Accordingly, like features will be identified by like numerals increased by a value of "3000." The heat sink 3500 of FIGS. 13 and 14 is shown as having a reflector 900 that is attached to the central portion 3502 and received in the arms 3504. The reflector 900 directs and focuses light emitted by the LED lighting arrangement (not shown). It is understood that a reflector may be used with the heat sink 500 of FIGS. 6 and 7 and all the variants thereof in a fashion similar to the arrangement shown in FIGS. 13 and 14.

The arms 3504 of the heat sink 3500 of FIGS. 12 and 13 are hollow and have an interior space 3522 that extends between the proximal end 3518 and the distal end 3520 of the arm 3504. Fins 3536 are provided in the interior space 3522. The fins 3536 increase the overall surface area of the heat sink 3500, thereby improving heat dissipation performance. A plurality of vents 3538 are provided on the arm 3504. The vents 3538 are in fluid communication with the interior space 3522. The vents promote 3538 convective airflow through the interior space 3522, consequently resulting in convective airflow over the fins 3536 and further improvement in the heat dissipation performance of the heat sink 3500.

In the illustrated embodiment, each arm 3504 includes three top surface vents 3538*a*, and four side surface vents 3538*b*. The top surface vents 3538*a* are all provided on a top surface 3540 of the arm 3504. Two side surface vents 3538*b* are provided on the first side surface 3534 of the arm, 3504 and two side surface vents 3538*b* are provided opposite on a second side surface 3542 of the arm opposite the vents 3538*b* of the first side surface 3534. All of the top surface vents 3538*a* and the side surface vents 3538 are stadium-shaped. In alternative embodiments, the heat sink may include a greater or fewer of number of vents, the vents may be provided at any desired location, and the vents may have any desired shape.

In the illustrated embodiment, the fins 3536 are provided along the entire length of the interior space 3522, and extend linearly from a bottom surface to a top surface of each arm 3504. In alternative embodiments, the fins may be curved, or extend at an angle.

The fins 3536 include full width fins 3536*a* and partial width fins 3536*b*. Full width fins 3536*a* are fins having a width that is equal to a distance between a first interior side wall and a second interior sidewall. Partial width fins 3536*b* are fins that have a width that is less than the distance between the first interior side wall and the second interior sidewall.

Beginning at the proximal end 3518 of the arm 3504 and moving along the longitudinal axis, there is provided a series of full width fins 3536*a*, then a first series a partial width fins 3536*b* that are aligned with one set of the side surface vents 3538*b*, another series of full width fins 3536*a*, then a second series of partial width fins 3536*b* that are aligned with the other set of the side surface vents 3538*b*, and finally another series of full width fins 3536*a* that continues through the 3520 distal end of the arm 3504. According to this arrangement, a plurality of airflow passages 3544 are formed in each arm 3504, with each airflow passage 3544 extending between the side surface vent 3538*b* and the tops surface vent 3538*a*. In alternative embodiments, the heat sink may include any desired arrangement of fins.

While the fins 3536 of only two arms 3504 are expressly shown in FIG. 13, it should be understood that each of the arms 3504 may have the same fin configuration that is shown. In an alternative embodiment, different arms may have different fin configurations.

Figure 15:
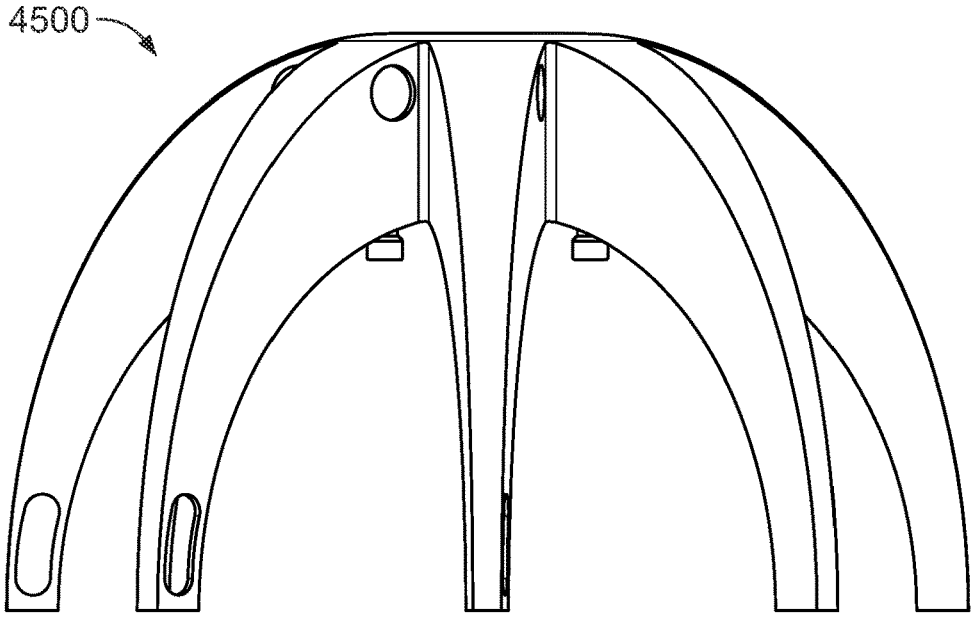
FIG. 15 is a side view of the heat sink of FIG. 14.
Figure 16:
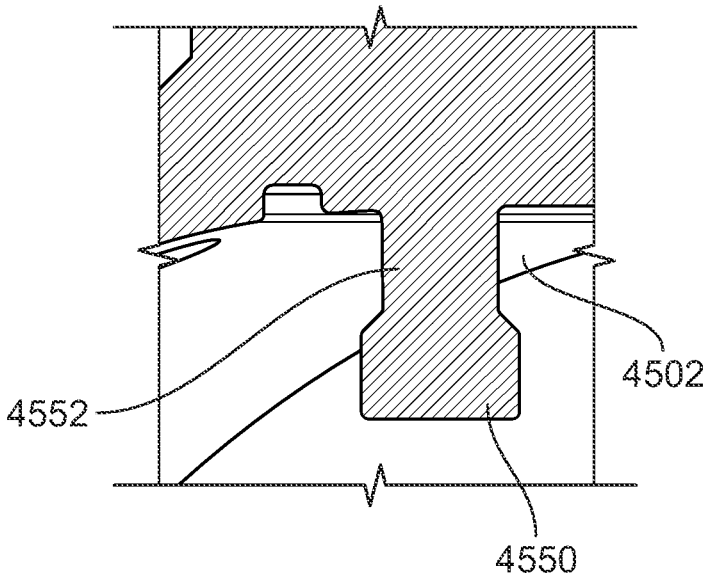
FIG. 16 is a detail view of part of the heat sink of FIG. 14.

FIGS. 14-16 show another variant of the heat sink of FIGS. 6 and 7. The heat sink of FIGS. 14-16 is substantially similar to the heat sink of FIGS. 6 and 7, except for the differences described herein. Accordingly, like features will be identified by like numerals increased by a value of "4000." The heat sink 4500 of FIGS. 14-16 is provided with locking tabs 4546 and a seal groove 4548. In use, the locking tabs 4546 may be used to attach a reflector, which may be similar to the reflector shown in FIG. 5 or FIG. 13, to the heat sink 4500. The seal groove 4548 may receive a seal. The seal creates a waterproof barrier between the heat sink 4500 and the reflector, thereby preventing the intrusion of moisture into the LED lighting arrangement that is attached to the central portion 4502.

In the illustrated embodiment, the heat sink 4500 includes two locking tabs 4546 that extend from the lower surface 4510 of the central portion 4502 at opposite sides of the central portion 4502. The locking tabs 4546 interact with a slot provided on the reflector (not shown) to attach the reflector to the heat sink 4500. Each locking tab 4546 includes a head portion 4550 and a neck portion 4552 that connects the head portion 4550 to the central portion 4502. The head portion 4500 has a diameter that is larger than a diameter of the neck portion 4552. In alternative embodiments, the locking tabs may have any desired arrangement and may be located on any desired part of the heat sink. In other alternative embodiments, the heat sink may include a greater or fewer number of locking tabs.

In the illustrated embodiment, the seal groove 4548 is defined by a recess provided on the lower surface 4510 of the central portion 4502. The recess is substantially circular and disposed radially outward of the locking tabs 4546. In alternative embodiments, the seal groove may have any desired arrangement and may be located on any desired part of the heat sink. In other alternative embodiments, additional seal grooves may be provided.

Figure 17:
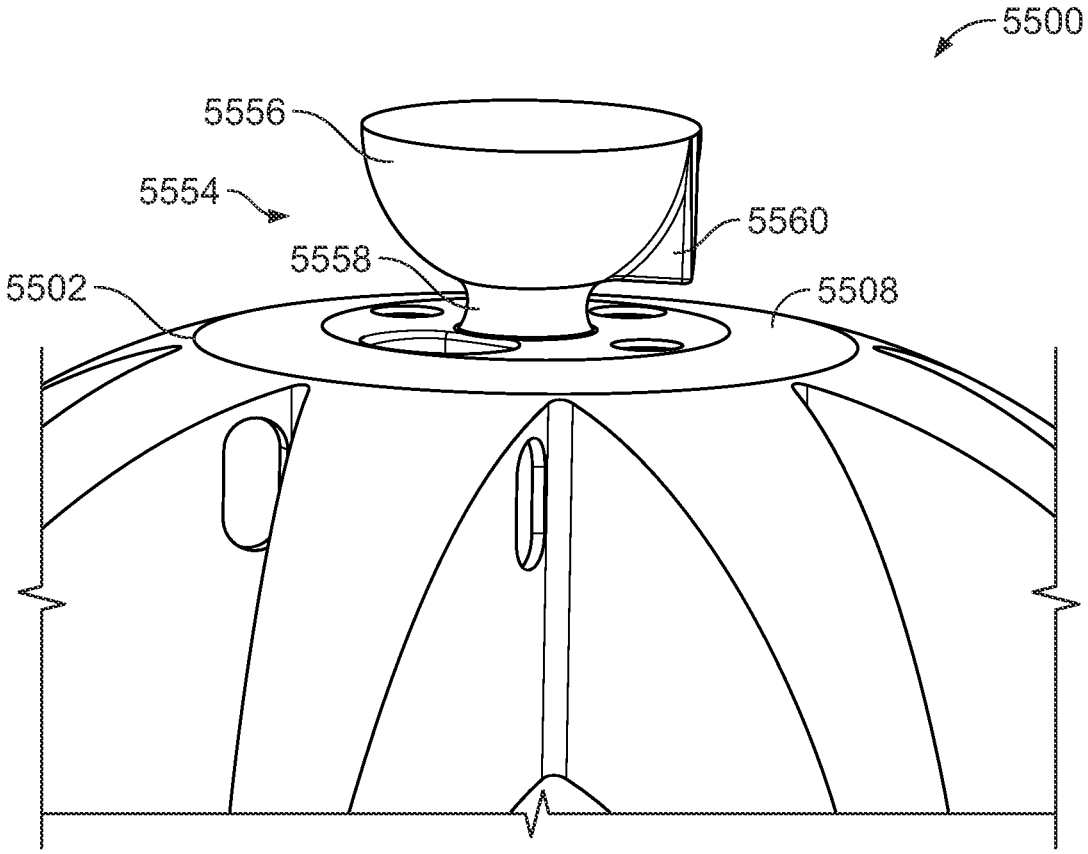
FIG. 17 is a top perspective view of part of another variation of the heat sink of FIGS. 6 and 7.
Figure 18:
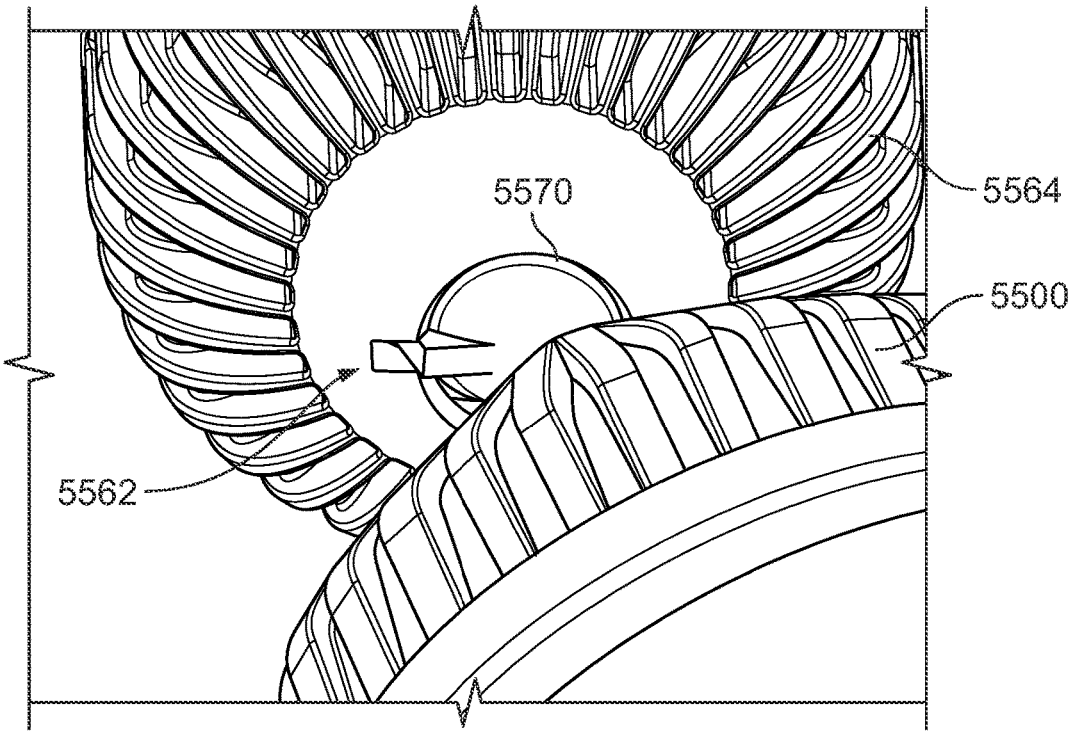
FIG. 18 is view of part of the heat sink of FIG. 15 interacting with a base.
Figure 19:
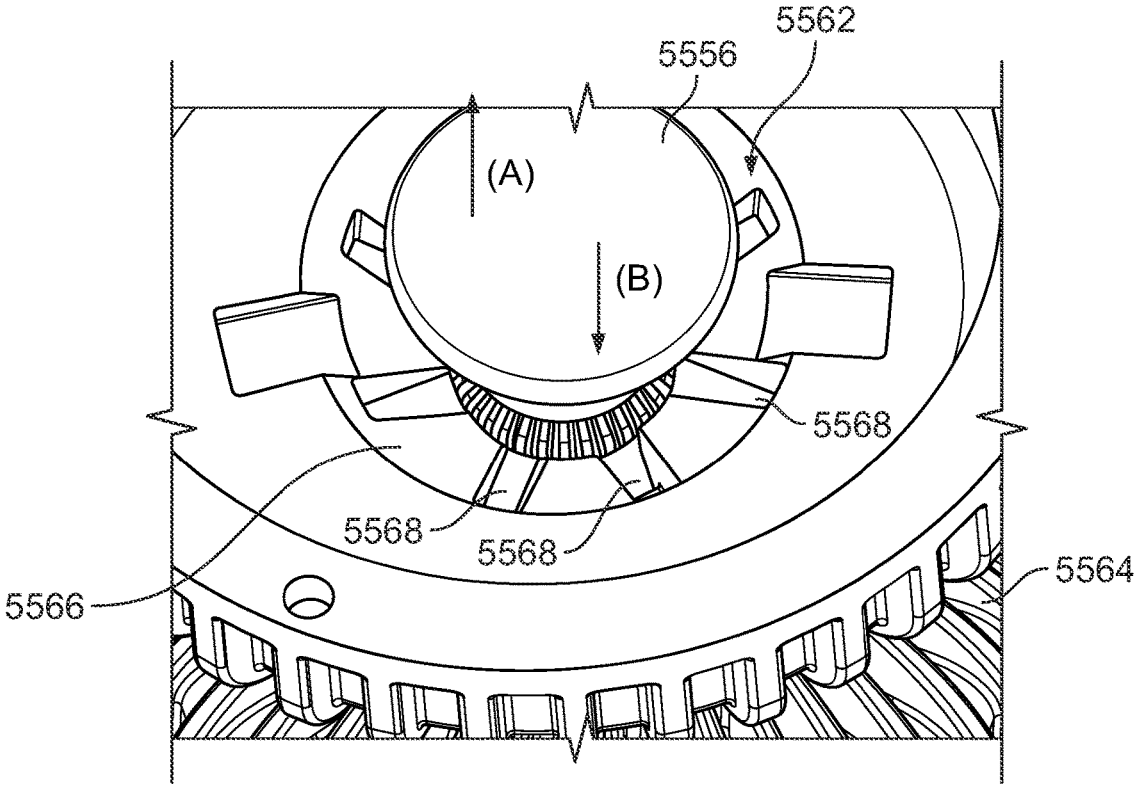
FIG. 19 is another view of the arrangement shown in FIG. 18.

FIGS. 17-19 show another variant of the heat sink of FIGS. 6 and 7. The heat sink of FIGS. 17-19 is substantially similar to the heat sink of FIGS. 6 and 7, except for the differences described herein. Accordingly, like features will be identified by like numerals increased by a value of "5000." The heat sink 5500 of FIGS. 17-19 includes a male adjustment part 5554. The male adjustment part 5554 is provided on upper surface 5508 of the central portion 5502. The male adjustment part 5554 includes a ball portion 5556 and a neck portion 5558. The neck portion 5558 connects the ball portion 5556 to the heat sink central portion 5502. The ball portion 5556 includes a locking tab 5560.

The male adjustment part 5554 is configured to interact with a female adjustment part 5562 that is provided on a base 5564. The female adjustment part 5562 includes a socket portion 5566. An interior surface of the socket portion 5566 is provided with a plurality of slots 5568. The slots 5568 extend radially outward from a central opening 5570.

When assembled, the neck portion 5558 of the male adjustment part 5554 extends through the central opening 5570 of the female adjustment part 5562, thereby causing the ball portion 5556 to be received in the socket portion 5566. Absent any external forces, the weight of the heat sink 5500 causes the ball portion 5556 to press against the interior surface of the socket portion 5566 and the locking tab 5560 is thus forced into engagement with one of the plurality of slots 5568. This engagement maintains the orientation of the heat sink 5500 relative to the base 5564, thereby directing the beam of light provided by the LED lighting arrangement in a desired location.

When it is desired to direct the beam of light in a different direction, the heat sink 5500 is moved relative to the base 5564 in direction (A), which causes the locking tab 5560 to be released from the slot 5568. The orientation of the heat sink 5500 is then free to be moved relative to base 5564 to a new orientation. Once the new orientation is set, the heat sink 5500 can be moved in direction (B) opposite direction (A), thus bringing the locking tab 5560 back into engagement with a different one of the plurality of slots 5568. The orientation of the heat sink 5500 relative to the base 5564 is then again fixed, and the beam of light is aimed in the desired new direction.

In each of the above examples, the various components of the LED luminaire of each embodiment may be manufactured using an additive manufacturing process, also known as 3D printing. Additive manufacturing is a process whereby an object is created by the deposition of successive of layers of material. The deposition of material layers may be controlled by a computer that reads a computer-aided design file. Categories of the additive manufacturing process include vat photopolymerization, material jetting, binder jetting, powder bed fusion, material extrusion, directed energy deposition, and sheet lamination.

The additive manufacturing process used to manufacture the various components of the LED luminaire may be executed using metal materials such as AlSi10Mg, copper, titanium, or any other desired metal material. The LED luminaire components may also be manufactured from polymers.

The additive manufacturing process enables the fabrication of heat sinks and other components having form factors that are not possible or difficult to produce using more traditional manufacturing techniques such as molding, extrusion, casting, or machining. In alternative embodiments, LED luminaire components may be manufactured using any desired process and out of any desired material.

One example of using an additive manufacturing process to manufacture a luminaire may include depositing layers of material to form a main portion having a first surface and a second surface. The method may further include securing an LED lighting arrangement to the first surface and depositing layers of material to form a heat dissipation structure. The heat dissipation structure may be provided on the second surface and include a plurality of fins. Each fin of the plurality of fins may include a V-shaped portion and a linear portion. The linear portion may connect the V-shaped portion to the main portion. The method may further include depositing layers of material to form a reflector. The reflector may be secured to the first surface. This method is merely exemplary. It is contemplated that the additive manufacturing process may be used to form any of the discrete embodiments and variants shown and described in FIG. 1-19.

While discrete embodiments and variants have been shown and described in FIGS. 1-19, the disclosed features are not exclusive to each described embodiment. Instead, various features can be combined on a heat sink as desired. For example, the tabs of FIGS. 14-16 may be used on the heat sink of FIGS. 8 and 9. As another example, the male adjustment part of FIGS. 17-19 may be used on the heat sink of FIGS. 6 and 7. As yet another example, the Y-shaped fins of FIGS. 3 and 4 may be used on the arrangement of FIGS. 1 and 2.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present application has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the application, in its broader aspects, is not limited to the specific details, the representative apparatus and method, and illustrative examples shown and described. For example, although the luminaire has been described as utilizing LEDs, similar concepts can be applied to luminaires using incandescent bulbs, or compact fluorescent lamps. Accordingly, departures may be made from such details without departing from the spirit or scope of the applicant's general inventive concept.

What is claimed is:

1. A heat sink for a luminaire comprising:

a central portion having a top surface and a bottom surface, the bottom surface being adapted to receive a lighting arrangement;

a plurality of arms configured to dissipate heat generated by the lighting arrangement, the plurality of arms extending radially outward from the central portion, each one of the plurality of arms being substantially arcuate between a proximal end and a distal end;

where at least one of the plurality of arms is hollow and defines an interior space that extends between the proximal end and the distal end;

wherein at least one vent is provided on the hollow arm, the at least one vent being in fluid communication with the interior space; and wherein the hollow arm includes a first side surface and a second side surface, and wherein the at least one vent includes a first vent and a second vent, the first vent being circular and provided on the first side surface toward the proximal end of the arm, the second vent being stadium-shaped and provided on the first side surface toward the distal end of the arm.

2. The heat sink of claim 1 further comprising a plurality of fins provided in the interior space.

3. The heat sink of claim 2, wherein the hollow arm includes a first interior sidewall and a second interior sidewall, and wherein the plurality of fins includes full width fins and partial width fins, the full width fins having a width that is equal to a distance between the first interior sidewall and the second interior sidewall, the partial width fins having a width that is less than the distance between the first interior sidewall and the second interior sidewall.

4. The heat sink of claim 1, wherein the interior space of the at least one of the plurality of arms is trapezoid shaped.

5. The heat sink of claim 1, wherein the plurality of arms are adapted to receive a reflector, the reflector being configured to direct and focus light emitted by the lighting arrangement.

6. The heat sink of claim 5 further comprising at least one locking tab that is configured to attach the reflector to the heat sink, the at least one locking tab including a head portion and a neck portion, the neck portion connecting the head portion to the central portion, the head portion having a diameter that is larger than a diameter of the neck portion.

7. The heat sink of claim 5 further comprising a seal groove formed as a circular recess on the central portion, the seal groove being configured to receive a seal for creating a waterproof barrier between the heat sink and the reflector.

8. The heat sink of claim 1 further comprising a male adjustment part, the male adjustment part being configured to interact with a female adjustment part provided on a base to connect the heat sink to the base, the male adjustment part including a ball portion that is received in a socket portion of the female adjustment part.

9. The heat sink of claim 8, wherein the male adjustment part includes a locking tab provided on the ball portion, and wherein the female adjustment part includes a plurality of slots provided on the socket portion, the locking tab engaging with one of the plurality of slots to fix an orientation of the heat sink relative to the base.

10. The heat sink of claim 1, wherein the lighting arrangement includes light emitting diodes.

11. The heat sink of claim 1, wherein the central portion and the arms cooperate to define a semi-spherical shaped interior space.

* * * * *